US005228465A

United States Patent [19]

Hill

[11] Patent Number: 5,228,465

[45] Date of Patent: Jul. 20, 1993

[54] HAIR CLAMP

[75] Inventor: Percy H. Hill, Silver Lake, N.H.

[73] Assignee: Stratford Laboratories, Chadds Ford, Pa.

[21] Appl. No.: 800,527

[22] Filed: Dec. 2, 1991

[51] Int. Cl.[5] ..... A45D 7/02

[52] U.S. Cl. ..... 132/212; 132/223; 132/273

[58] Field of Search ..... 132/212, 223, 224, 263, 132/267, 273, 275, 278

[56] References Cited

U.S. PATENT DOCUMENTS

| | | | |
|---|---|---|---|
| 2,699,789 | 1/1955 | Goodman | 132/278 |
| 2,776,667 | 1/1957 | Fitzgerald | 132/224 |
| 2,818,869 | 1/1958 | Rose | 132/224 |
| 2,818,871 | 1/1958 | Beaudry | 132/278 |
| 3,128,778 | 4/1964 | Ricci et al. | 132/212 |
| 3,198,196 | 8/1965 | Sawin | 132/212 |
| 3,419,017 | 12/1968 | Solomon et al. | 132/223 |
| 3,608,565 | 9/1971 | Ensign | 132/212 |
| 3,662,767 | 5/1972 | Murtha | 132/212 |
| 3,871,388 | 3/1975 | Leoci | 132/223 |
| 4,671,302 | 6/1987 | Hill | 132/212 |
| 4,913,174 | 4/1990 | Cusenza | 132/273 |

FOREIGN PATENT DOCUMENTS 0251968 1/1988 European Pat. Off. ..... 132/212

*Primary Examiner*—Gene Mancene
*Assistant Examiner*—Frank A. LaVick
*Attorney, Agent, or Firm*—Norman E. Lehrer

[57] ABSTRACT

A hair clamp has an outer shell comprised of a thin substantially rigid plastic material The shell includes a front portion and a rear portion each of which is separately hinged to a spine portion. The inner surface of the shell is covered with a layer of foam material which is bonded to the spine portion. The shell and the foam material are foldable about the hinges to form a clamp having front and back halves with the foam material in the inside thereof. A lock integral with the plastic shell is adapted to maintain the clamp in its closed position. The outer configuration of the hair clamp is substantially rectangular. However, the bottom of the device is somewhat concavely curved while the top is convexly curved. This allows the device to be placed close to the person's head since the bottom fits the contour of the head. The hair clamps can also be stacked vertically one on top of the other for longer hair.

3 Claims, 2 Drawing Sheets

HAIR CLAMP

BACKGROUND OF THE INVENTION

The present invention is directed toward a hair clamping device and more particularly toward such a device which is intended to hold a hank of hair being straightened or otherwise treated and which is extremely simple to utilize and easily and cheaply manufactured so that the same can be made to be disposable.

While the camp of the present invention may be used for various types of hair treatments such as tinting, frosting, selectively coloring, streaking, etc., it is particularly useful for straightening curly hair. Devices for straightening curly hair have been known for some time. Many prior art devices such as shown in U.S. Pat. Nos. 1,432,251; 1,986,689 and 2,419,117 utilize electric heating means to accomplish the straightening. While such devices may be somewhat effective in straightening the hair, they can also cause extensive damage to the hair because of the temperature and duration of the heat which must be applied in order to be effective. Furthermore, the cost of these devices is relatively high.

Other devices for use with chemical straightening of hair have also been proposed. Examples of these devices are shown in U.S. Pat. Nos. 2,955,604; 3,343,548 and 3,367,345. Insofar as Applicant can determine, the device shown in the first of these patents cannot be effective since means are not provided for maintaining the hair in a straight or tensioned condition during use. The latter two patents are useful only for straightening the portions of the hair adjacent the scalp. These devices cannot be used for straightening the entire length of the person's hair.

A wide variety of devices are also disclosed in the prior art for use in tinting or coloring hair. These are shown, for example, in U.S. Pat. Nos. 2,299,017; 2,299,018; 2,962,031 and 3,101,724. Such devices, however, are useful only for coloring or tinting and cannot be used for other purposes such as for straightening.

There is one prior art device which has been proposed specifically for use in dying hair at the roots but which could be used in a hair straightening process although there has been no previous suggestion for using the device in that manner. This device is shown in U.S. Pat. No. 3,662,767. The device of that patent is a box or cylindrically shaped hinged shell which carries a foam pad therein. The device is clamped around a hank of hair and is held in a closed position by a clasp mounted thereon. Because of the shape of these patented devices, only a limited number of them can be applied to a person's hair since they would otherwise interfere with each other. Furthermore, because of the shape of the ends of the devices, they cannot be placed too close to a person's head.

U.S. Pat. No. 4,671,302 which issued to the present Applicant describes a device which was intended to fill the gap left by the prior art devices described above. The prior patented device was directed toward a hair clamp which was specifically designed for straightening hair. It was comprised of an outer shell made of a sheet-like material such as cardboard or the like having its inner surface covered with a layer of foam material. The shell and the foam liner were folded over upon themselves along a mid-portion to form a clamp having front and back halves and a foam liner in the inside thereof. A separate U-shaped plastic clamp or plastic wire twist device was used to maintain the hair clamp in its closed position. The outer configuration of Applicant's prior patented hair clamp had a concavely curved bottom and a convexly curved top so that the same would fit closer to a person's head and so that a plurality of clamps could be stacked vertically on top of each other for longer hair.

While the device shown in Applicant's prior U.S. Pat. No. 4,671,302 had certain theoretical advantages over the prior art, it was not believed to be commercially practicable. The cardboard from which the shell was made was not rigid enough to hold the clamp in a tightly closed condition. This problem became even more pronounced when the device was in use and the cardboard was wetted by the straightening solution Furthermore, the single fold hinge put too much pressure on the foam at the hinge and relieved the force or pressure on the remaining surfaces of the foam. And finally, the tie lock used with the prior device was difficult to attach while the U-shaped clamp could easily be lost. As a result, Applicant's prior patented device was never commercially successful.

SUMMARY OF THE INVENTION

The present invention is designed to be a significant improvement over Applicant's prior patented device and is believed to overcome all of the defects of the prior art The universal hair clamp of the present invention has an outer shell comprised of a thin substantially rigid plastic material. The shell includes a front portion and a rear portion each of which is separately hinged to a spine portion. The inner surface of the shell is covered with a layer of foam material which is bonded to the spine portion. The shell and the foam material are foldable about the hinges to form a clamp having front and back halves with the foam material in the inside thereof. A lock integral with the plastic shell is adapted to maintain the clamp in its closed position. The outer configuration of the hair clamp is substantially rectangular. However, the bottom of the device is somewhat concavely curved while the top is convexly curved. This allows the device to be placed close to the person's head since the bottom fits the contour of the head. The hair clamps can also be stacked vertically one on top of the other for longer hair.

BRIEF DESCRIPTION OF THE DRAWINGS

For the purpose of illustrating the invention, there is shown in the accompanying drawings one form which is presently preferred; it being understood that the invention is not intended to be limited to the precise arrangements and instrumentalities shown.

DETAILED DESCRIPTION OF THE PREFERRED EMBODIMENT

Figure 1:
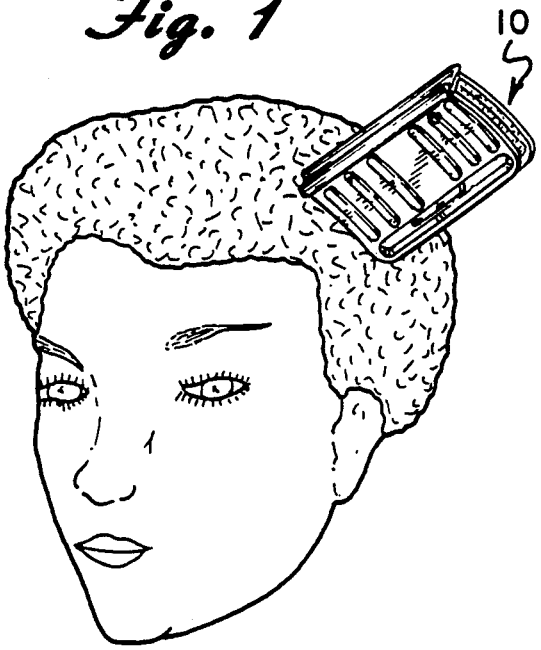
FIG. 1 is a schematic representation showing the manner in which a hair clamp constructed in accordance with the principles of the present invention is applied to a person's hair.
Figure 2:
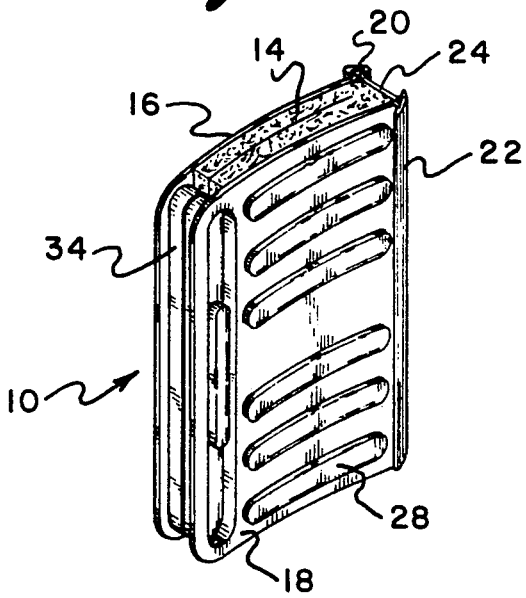
FIG. 2 is a front perspective view of a hair clamp in its closed position.
Figure 4:
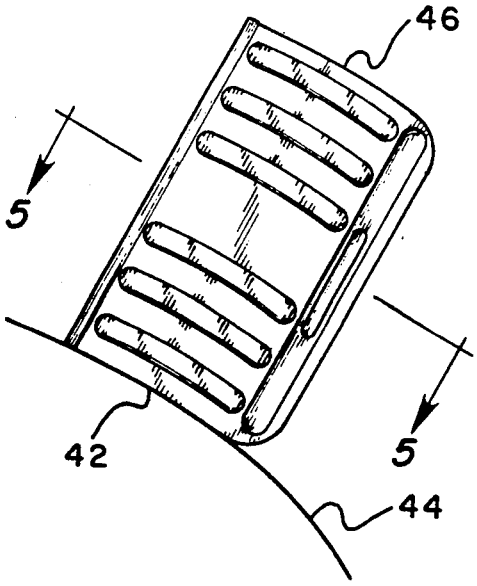
FIG. 4 is an elevational view showing the hair clamp in position on a person's head.
Figure 3:
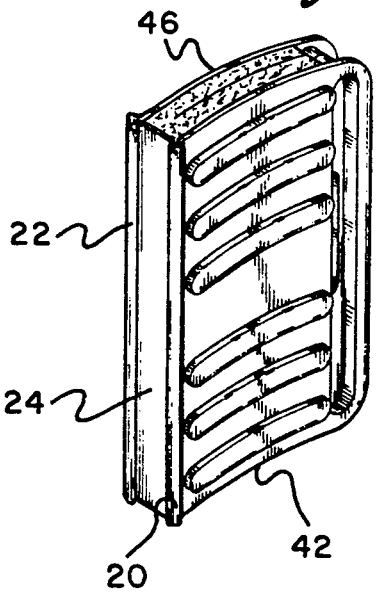
FIG. 3 is a rear perspective view similar to FIG. 2.
Figure 5:
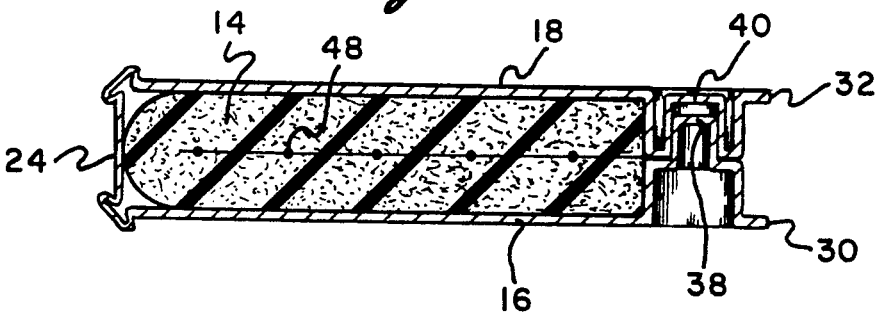
FIG. 5 is a cross-sectional view taken through the line 5—5 of FIG. 4.

Referring now to the drawings in detail wherein like reference numerals have been used throughout the various figures to designate like elements, there is shown in the figures a hair clamp constructed in accordance with the principles of the present invention and designated generally as 10. FIGS. 1, 4 and 5 illustrate the clamp 10 as used on a person's head while the remaining figures show the clamp generally in both its closed and open positions.

Figure 6:
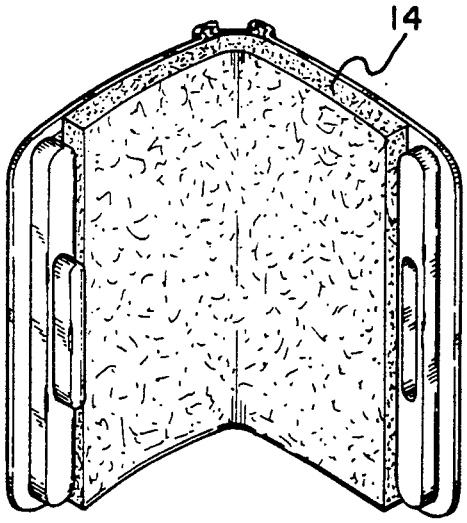
FIG. 6 is a perspective view similar to FIG. 2 but showing the hair clamp in its open position.
Figure 7:
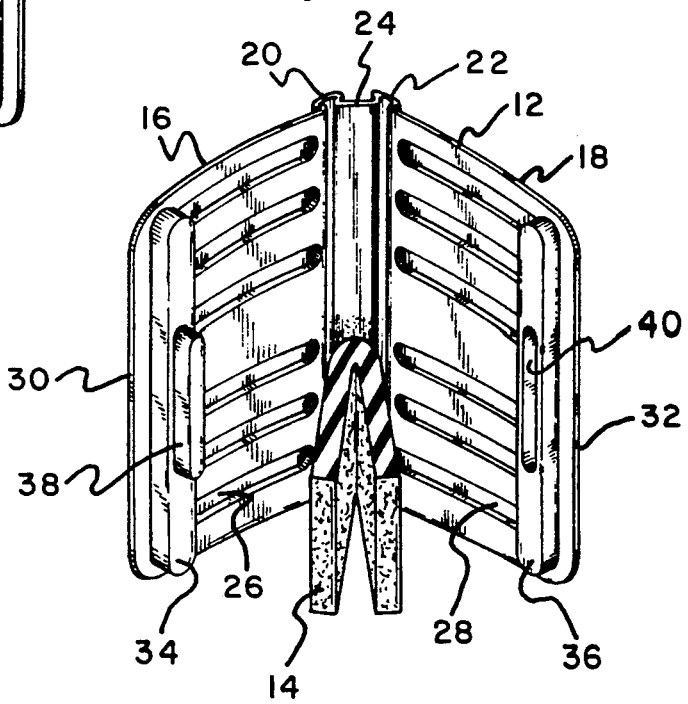
FIG. 7 is a view similar to FIG. 6 but showing a portion of the foam liner cut away for clarity.

As shown most clearly in FIGS. 5, 6 and 7, the hair clamps 10 are comprised essentially of two parts. An outer shell 12 and a resilient liquid-absorbing liner 14. The outer shell 12 is made from a substantially rigid sheet-like plastic material so as to be waterproof. The sheet material from which the shell 12 is made is relatively thin so as to be flexible, where desired.

The shell 12 has a front portion 16 and a rear portion 18. These are hinged respectively through living hinges 20 and 22 to spine portion 24. For the reasons which will become clear hereinafter, the width of the spine portion between the living hinges 20 and 22 is chosen to be slightly less than twice the thickness of the resilient member 14. The hinges 20 and 22 allow the front and rear portions 16 and 18 to be moved between an open condition as shown in FIGS. 6 and 7 to a closed position as shown in the remaining figures wherein the inner surfaces of the front and rear portions face each other.

In order to provide the outer shell member 12 with structural rigidity, both the front and rear portions 16 and 18 are provided with a plurality of ribs such as shown at 26 and 28, respectively. These ribs are vacuum formed or otherwise molded into the material from which the shell is made. In fact, the entire shell including all of the component elements thereof is preferably vacuum molded or similarly formed. The ribs 26 and 28 are preferably formed so as to extend widthwise. That is, they extend from adjacent the spine 24 toward the free edges 30 and 32 of the front and rear shell portions, respectively. Furthermore, these ribs 26 and 28 are preferably molded so as to extend outwardly toward the outer surface of the shell 12 so as not to interfere with the liner 14.

Also formed on the front shell portion 16 and adjacent the free edge 30 is an inwardly extending rib 34. A similar rib 36 is formed in the rear portion 18 adjacent its free edge 32. Ribs 34 and 36 run vertically, substantially perpendicular to the ribs 26 and 28. Furthermore, they extend inwardly toward each other. The height of each rib 34 and 36 is slightly less than the thickness of the liner 14 and the combined height of the ribs 34 and 36 are substantially equal to the width of the spine portion 24. As a result and as can best be seen in FIG. 5, when the clamp 10 is closed, the ribs 34 and 36 engage each other and the shell 12 forms an internal opening of substantially rectangular cross section.

Located substantially centrally of the rib 34 is a locking projection 38. Projection 38 is preferably elongated and extends up from the inner surface of the rib 34. A similarly shaped recess 40 is formed in the central portion of the rib 36. The projection 38 is designed so as to fit within the recess 40. However, the projection 38 is slightly larger than the recess 40 so as to form a friction fit therein. As a result, when the clamp is in its closed position as shown best in FIG. 5, the projection 38 fits tightly within the recess 40 and locks the front and rear portions 16 and 18 together. They can, however, of course be separated by manually pulling the two portions apart.

The liner 14 is preferably made from a liquid absorbing polyurethane foam or similar material. It has a thickness of approximately $\frac{1}{8}$ to $\frac{1}{4}$ of an inch and is of a size which covers substantially the entire area of the inside of the shell 12 between the ribs 34 and 36. While the liner 14 can be glued or otherwise adhered to the entire inner face of the front and rear portions 16 and 18, it has been found that the best results are obtained when the liner is adhered only to the spine 24. When this is done, the liner can be made to be slightly shorter than the full distance from the rib 34 to the rib 36 and as the clamp 10 is closed, the liner is found to extend outwardly to fill the entire space.

Although the outer configuration of the hair clamp 10 is substantially rectangular in shape, the bottom edge 42 is somewhat concave. This concave edge allows the clamp to be positioned very close to the person's scalp since it is complementary to the convex shape of the person's head as shown at 44 in FIG. 4. The upper edge of each hair clamp 10 is convexly shaped such as shown at 46 and is complementary to the concave shape of the lower edge of each clamp. This allows the hair clamps to be stacked one on top of the other in an end to end relationship if desired so that the same can be used on longer hair.

As should be readily apparent to those skilled in the art, the hair clamp 10 can be used for a wide variety of hair treating purposes. It is, however, particularly useful for straightening hair. As a hair straightener, the clamps are used in the following manner. A hank of hair to be straightened is manually tensioned. A quantity of known hair relaxing solution is then applied directly to the hair and/or to the foam liner 14. The clamp, in its open position, is then aligned so that the concave bottom overlies the person's head and the hair extends through the height of the foam pad. The front and rear portions 16 and 18 are then closed and are clamped into the closed position by the use of the locking mechanism 38, 40.

When the front and rear portions 16 and 18 are in the clamped position, the two halves of the foam liner 14 are compressed against each other and, therefore, maintain the hair in the straight position in which it was held before the clamp 10 was closed. FIG. 5 illustrates a plurality of strands of hair 48 clamped between the two halves of the foam liner 14. After sufficient time has elapsed to provide sufficient depolymerization of the hair protein, the clamps are removed by simply pulling them off the hair lengthwise and the hair is then washed with a shampoo which contains a neutralizer. The used clamps can then be disposed of.

The present invention may be embodied in other specific forms without departing from the spirit or essential attributes thereof and accordingly reference should be made to the appended claims rather than to the foregoing specification as indicating the scope of the invention.

I claim:

1. A hair clamp comprising:

an outer shell comprised of a thin substantially rigid plastic material, said plastic material having a plurality of ribs formed therein to provide structural rigidity;

said outer shell having a front portion, a rear portion a spine portion, and a pair of spaced apart parallel hinges arranged on opposite side edges of said spine portion, said front and rear portions each having a hinge edge and a free edge remote from said hinge edge, said hinge edges of said front and rear portions being separately hinged to different ones of said hinges;

at least some of said ribs being on said front and rear portions and being aligned perpendicular to said spine portion;

a synthetic foam liner covering the majority of the interior surface of said shell, said foam having front and rear portions and being bonded to the inner surface of said spine portion;

said front and rear portions of said shell being separately foldable toward each other along said hinges with the front and rear portions of said liner facing each other and forming a clamping surface for holding a hank of hair therebetween;

the free edge of said front portion having a raised member facing said rear portion and the free edge of said rear portion having a recess therein, said raised member being adapted to fit within said recess to lock said front and rear portions in a closed and clamped condition;

the outer configuration of said clamp having a concave bottom and a convex top so that the bottom of said clamp can fit the contour of a person's scalp and whereby the top thereof can fit within the concave bottom of a similarly constructed clamp.

2. A hair clamp comprising:

an outer shell comprised of a thin substantially rigid plastic material, said plastic material having a plurality of ribs formed therein to provide structural rigidity;

said outer shell having a front portion, a rear portion a spine portion, and a pair of spaced apart parallel hinges arranged on opposite side edges of said spine portion, said front and rear portions each having a hinge edge and a free edge remote from said hinge edge, said hinge edges of said front and rear portions being separately hinged to different ones of said hinges;

at least some of said ribs being on said front and rear portions and being aligned perpendicular to said spine portion;

a synthetic foam liner covering the majority of the interior surface of said shell, said foam liner having front and rear portions corresponding to the front and rear portions of said shell;

said front and rear portions of said shell being separately foldable toward each other along said hinges with the front and rear portions of said liner facing each other and forming a clamping surface for holding a hank of hair therebetween;

means for temporarily locking said front and rear portions of said shell in a closed and clamped condition;

the other configuration of said clamp having a concave bottom and a convex top so that the bottom of said clamp can fit the contour of a person's scalp and whereby the top thereof can fit within the concave bottom of a similarly constructed clamp.

3. The invention as claimed in claim 2 wherein said locking means is comprised of the free edge of said front portion having a raised member facing said rear portion and the free edge of said rear portion having a recess therein, said raised member being adapted to fit within said recess to lock said front and rear portions in said closed and clamped condition.

* * * * *